United States Patent [19]

Huang

[11] Patent Number: 4,817,798

[45] Date of Patent: Apr. 4, 1989

[54] CASSETTE TAPE HOLDING BOX AND DISPENSER

[75] Inventor: Harrison Huang, Shenkang, Taiwan

[73] Assignee: Glory Formosa Co., Ltd., China

[21] Appl. No.: 145,570

[22] Filed: Jan. 19, 1988

[51] Int. Cl.[4] ..... B65D 85/67

[52] U.S. Cl. ..... 206/411; 206/408

[58] Field of Search ..... 206/390, 411, 408, 413

[56] References Cited

U.S. PATENT DOCUMENTS

| | | | |
|---|---|---|---|
| 4,042,168 | 8/1977 | Kasel et al. | 206/411 |
| 4,291,801 | 9/1981 | Basili et al. | 206/387 |
| 4,339,035 | 7/1982 | Marcus et al. | 206/390 |
| 4,496,048 | 1/1985 | Sykes | 206/387 |

FOREIGN PATENT DOCUMENTS

| | | | |
|---|---|---|---|
| 2827185 | 1/1979 | Fed. Rep. of Germany | 206/411 |
| 150234 | 3/1955 | Sweden | 206/411 |

*Primary Examiner*—Joseph Man-Fu Moy

*Attorney, Agent, or Firm*—Darby & Darby

[57] ABSTRACT

A tape holding box and dispenser in the general form of rectangular parallelepiped for holding and dispensing adhesive tape from a tubular roll. The box and dispenser comprises a receptacle made from plastic having an aligned parallel pair of front and rear walls, an aligned parallel pair of substantially rectangular side walls with an opening or hole on it and a top panel connecting corresponding segments of the upper edge of the side walls, front wall and rear wall. On each of the inner surface of the side walls, there are some bosses with small height around the hole respectively for supporting the end of the tape spool, the top panel and side walls defining an opening for dispensing tape from the roll. The front portion of the top panel forms a depression at its front edge adjacent to the upper edge of the front wall for receiving a cutting means and a protruding rim with a narrow top surface at its rear edge to maintain the end portion of the tape at a certain height position relative to the upper surface of the top panel when the dispenser is not in use.

5 Claims, 3 Drawing Sheets

CASSETTE TAPE HOLDING BOX AND DISPENSER

BACKGROUND OF THE INVENTION

This invention relates to the field of portable holding box and despenser for adhesive or pressure-sensitive tape.

It is well known in the art to provide receptacles or containers for pressure-sensitive tape, e.g. transparent or other thin plastic tape or paper tape, which containers are equipped with a cutting device, typically a flat element having plastic or metal teeth suitable for tearing the tape. Typically, such prior art devices are designed so that a roll of tape can be positioned in them, and when it is desired to use a portion of the tape, the user unrolls a desired segment of tape and then draws the tapes across the cutting edge, severing the segment from the remainder of the roll. This leaves an end portion of tape extending from the unused or stored edge to the cutting edge. After use of the dispenser, such an end portion is left suspended only on the teeth of the cutting edge. Consequently, the suspended portion often comes loose from the teeth and falls back onto the roll and adheres there. This makes it necessary for the user to find the end where it adheres to the roll and disengage or free a portion of it to grasp each time the device is used. Also, when the suspended portion falls back agains the roll, it may be in a wrinkled or distorted configuration or it may contact an inner wall of the container, such that, in either case, the adhesive characteristic of the segment are reduced or destroyed. This makes it necessary to sever and discard the ruined portion before the device is next used.

The problem of having the end of the tape suspended only on the teeth of the cutting edge can be eliminated by running the portion over a wide flat surface between the stored roll and the cutting edge. With this kind of device, the segment of tape running from the unused roll to the cutting edge will contact and adhere to the wide surface sufficiently securely to keep it from falling back into the dispenser and adhering to the roll or to the inner walls. Unfortunately, when the tape is stored in this manner, i.e. in contact with a wide supporting surface between the roll and the cutting edge, this also may ruin the adhesive characteristics of the contact portion of the tape when it is pulled loose from the wide surface. Also, this type of device will make it difficult for the user to grasp the end portion of the tape, and typically, one will have to scrape the tape loose from the wide surface, again destroying a segment, which will have to be discarded before the remainder can be used.

Lack of structural rigidity is still another problem with prior art tape dispensers. It is highly desirable to make dispensers from inexpensive paperboard or cardboard so that they can be discarded after the tape is consumed. However, for such inexpensive dispensers, the structures often tend to become torn or damaged long before the roll of tape is consumed. When the cutting edge is supported on paperboard or cardboard of that type, it is often difficult to use it to tear the tape, since the structure is not sufficiently rigid to resist being deformed.

There has been a long felt need for an inexpensive disposable dispenser which is sufficiently sturdy to be durable and long-wearing. It is also desirable to provide such a dispenser that is designed to provide a means for allowing the user to grip the end of the tape for pulling it from the roll without the necessity of scraping it loose from either the body of the dispenser or from the roll of tape itself. It is also desirable that such a dispenser be provided with a means for supporting the end portion of the tape when the dispenser is not in use, so that the end portion will not adhere so tightly that its adhesive qualitites are diminished when it is pulled loose for use.

These and other objects are achieved in accordance with the present invention.

SUMMARY OF THE INVENTION

This invention contemplates a tape holding box and dispenser in the general form of rectangular parallelepiped for holding and dispensing adhesive tape from a tubular roll. The box and dispenser comprises a receptacle made from plastic having an aligned parallel pair of front and rear walls, an aligned parallel pair of substantially rectangular side walls with an opening or hole on it, a top panel connecting corresponding segments of the upper edge of the side walls, the front wall and the rear wall. On each of the inner surface of the side walls, there are provided with some bosses for supporting the tape roll. A tape roll can be put into the receptacle due to its elasticity.

The top panel and side walls define an opening for dispensing tape from the roll. Between the upper edge of the front wall and front edge of the top panel there is a depression for receiving a standing cutting means. Beside the both ends of the cutting means, a protrusion extends upwardly from each front upper edge of the side walls which is higher than the upper surface of cutting means for preventing the cutting means from being damaged and user's hands from being hurt.

The front portion of top panel forms a protruding rim of small height extending upwardly at its rear edge. This protruding rim with a narrow top surface serves as an easy-release planar retaining surface for releasably securing the tape so as not to fall back against the roll when the dispenser is not in use, and a positioning member for maintaining the end portion of the tape at a certain high position relative to the surface of the top panel.

A more complete understanding of these and other features and advantages of the present invention will become apparent from a careful consideration of the following detailed description of certain embodiments illustrated in the accompanying drawings.

DESCRIPTION OF THE PREFERRED EMBODIMENTS

Figure 1:
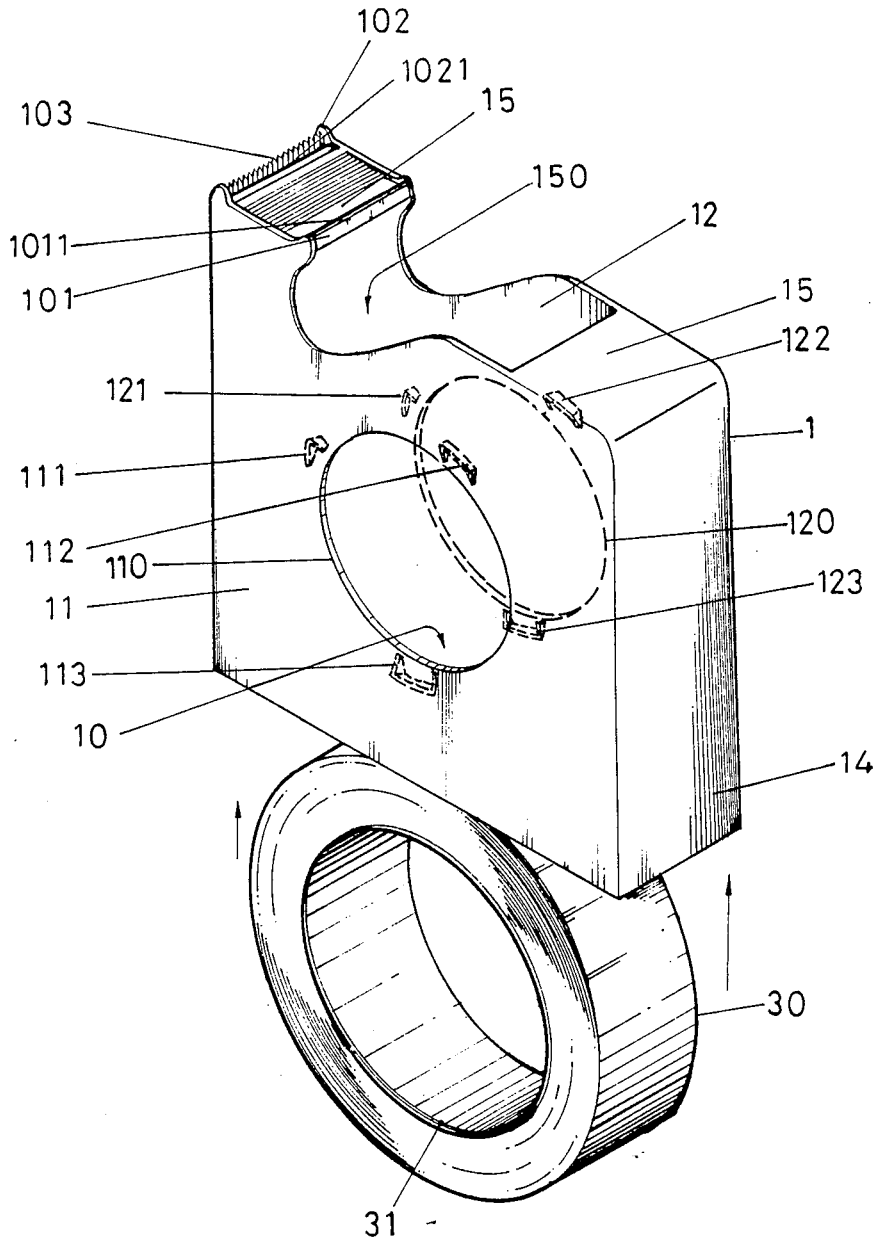
FIG. 1 is a perspective view showing a fully assembled preferred example of the invention.
Figure 2:
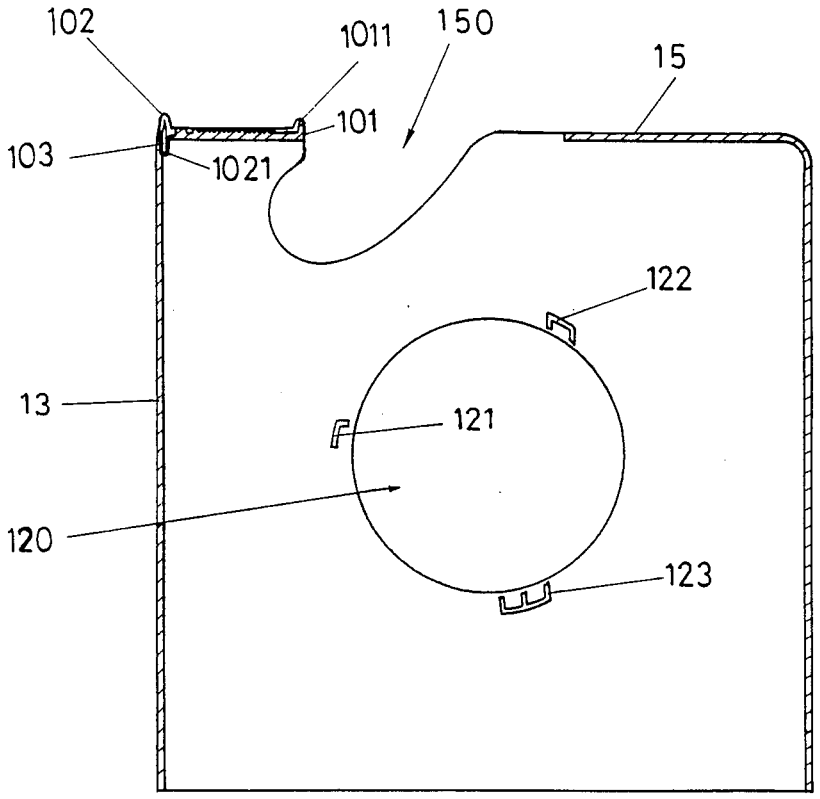
FIG. 2 is an exploded perspective view showing the inner structure of the invention of FIG. 1.

Referring to the FIGS. 1 and 2 of the drawings, there is shown a generally parallelepiped receptacle 1 open at the bottom. The receptacle 1 is formed by a pair of aligned parallel front and rear walls 13, 14, and another pair of aligned parallel side walls 11, 12, and a top panel 15 running transversely between corresponding segment of the upper edges of the side walls. The receptacle 1 is sized for enclosing and containing a tape roll 30 on a core or spool 31 for housing the tape roll, the axis of the core running perpendicular to the side walls. On each of the side walls 11, 12, there is a hole 110, 120 at its central part respectively. On each of the inner surface of the side walls 11, 12, there are provided with the bosses 111, 112, 113; 121, 122, 123 with small height around the hole 110, 120 respectively for supporting the tape roll 30. The top panel 15 and side walls 11, 12 also defines an opening 150 for dispensing tape from the roll. On the front portion of the top panel 15 which forms a hollow 1021 at its front edge adjacent to the upper edge of the front wall and a protruding rim 101 with a narrow top surface 1011 at its rear edge adjacent to the opening 150. Hollow 1021 receives a cutting means 103. Moreover, beside the both ends of the cutting means 103, protrusion 102 extends upwardly from the front upper edge of each side wall.

Because of the elasticity of the receptacle 1, the tape roll 30 can be easily put into the receptacle with the core 31 and supported by the bosses 111, 112, 113; 121, 122, 123.

Figure 3:
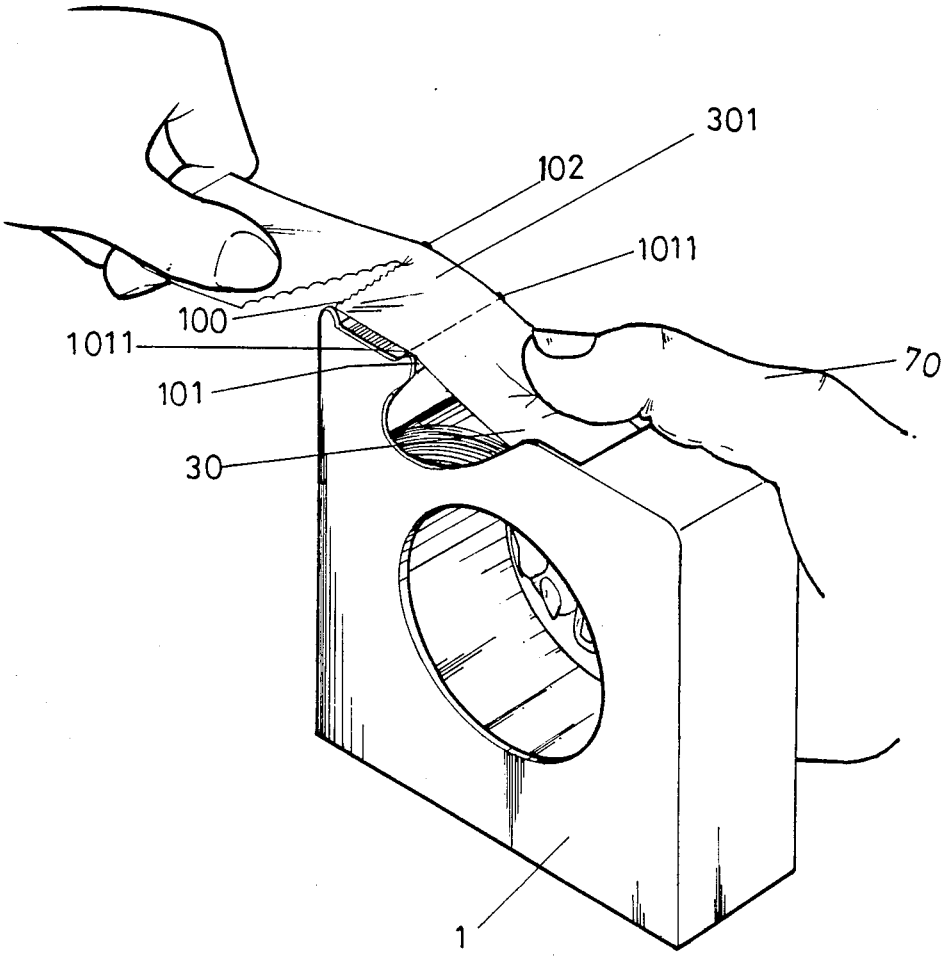
FIG. 3 is a perspective view showing the position of the tape in using.

As shown in the FIG. 3, in using this invention, the protruding rim 101 stands on the rear edge of the front portion of the top panel 15 effects the fraction of the segment of the tape 301 to be pressed down upon the embossed narrow retaining surface 1011 when the dispenser is not in use, the user's hand 70 grips the dispenser with the fingers in the hole on the side wall of the receptacle and the thumb presses down upon the tape roll 30 to stop rotation of the roll within the receptacle.

The unique characteristics of the invention permit it to perform consistently, also because the dispenser is made from plastic, its life always greatly exceeds the ordinary life of a roll or tape. Thus, if desired, the dispenser can be used over and over by removing the core or spool 31 from the dispenser and replacing it with a new roll of tape.

Many other uses and variations of the invention will be apparent to those skilled in the art, and while specific embodiments of this invention have been described, these are intended for illustrative purposes only. It is intended that the scope of the invention be limited only by the attached claims.

I claim:

1. A portable holding box and dispenser for adhesive or pressure-sensitive tape comprising a receptacle to contain the roll of tape which is formed by a pair of aligned parallel front and rear walls, another pair of aligned parallel side walls and a top panel running transversely between corresponding segments of the upper edge of the side walls, said sidewalls being flexible; on each of the side walls, there is a hole at a central part respectively; on each inner surface of the side walls, a plurality of bosses having small height being disposed around the central hole respectively, the top panel and the side walls also defining an opening for dispensing tape from the roll, said receptacle being open at the bottom for insertion of a new roll of tape or removal of a used roll of tape, said roll being inserted or removed by outwardly flexing the sidewalls.

2. A portable holding box and dispenser for adhesive or pressure-sensitive tape as claimed in claim 1, wherein the front portion of the top panel forms a depression at its front edge adjacent to the upper edge of the front wall, a standing cutting means being mounted in said depression, and a protruding rim being disposed at a rear edge of said top panel adjacent to the opening, said cutting means and rim for maintaining an end portion of tape at a certain height above the upper surface of the top panel.

3. A portable holding box and dispenser for adhesive or pressure-sensitive tape as claimed in claim 2, wherein the protruding rim has a narrow retaining surface.

4. A portable holding box and dispenser for adhesive or pressure-sensitive tape as claimed in claim 1, wherein each side wall forms a protrusion extending upwardly from its front upper edge which is beside the end of the cutting means and higher than the upper surface of the cutting means.

5. A portable holding box and dispenser as claimed in claim 1 wherein said receptacle is in the form of a rectangular parallelepiped and is of a plastic construction.

* * * * *

Disclaimer 4,817,798—*Harrison Huang,* Shenkang, Taiwan. CASSETTE TAPE HOLDING BOX AND DISPENSER. Patent dated Apr. 4, 1989. Disclaimer filed Apr. 8, 1991, by the assignee, Sunclipse, Inc.

Hereby enters this disclaimer to claims 1, 2, 3, 4, and 5, of said patent.

[ *Official Gazette July 30, 1991* ]